United States Patent [19]

Nalbach

[11] Patent Number: 4,567,923

[45] Date of Patent: Feb. 4, 1986

[54] APPARATUS FOR FILLING TANKS WITH LIQUEFIED GAS

[75] Inventor: John C. Nalbach, Western Springs, Ill.

[73] Assignee: John R. Nalbach Engineering Co., Inc., Chicago, Ill.

[21] Appl. No.: 702,343

[22] Filed: Feb. 15, 1985

[51] Int. Cl.[4] ..... B65B 3/28

[52] U.S. Cl. ..... 141/82; 141/83

[58] Field of Search ..... 73/52; 141/4, 39, 83, 141/164, 82; 177/55, 56, 57

[56] References Cited

U.S. PATENT DOCUMENTS

| | | | |
|---|---|---|---|
| 1,659,384 | 2/1928 | Thomas | 141/4 |
| 1,995,699 | 3/1935 | Baker et al. | 73/52 X |
| 2,408,202 | 9/1946 | Dickman | 73/52 X |
| 4,053,001 | 10/1977 | Healy et al. | 141/83 X |
| 4,351,372 | 9/1982 | Delgado, Jr. | 141/83 X |

*Primary Examiner*—Stephen Marcus
*Assistant Examiner*—Mark Thronson
*Attorney, Agent, or Firm*—Anthony S. Zummer

[57] ABSTRACT

The present invention relates to an improved apparatus for filling tanks with liquid gas. The apparatus includes a carrier for receiving tanks adapted for holding liquid gas. The carrier moves the tanks from one station to another. A filling device is provided at one station for delivering liquid gas under pressure to a tank. An apparatus identifies the amount of liquid gas in the tank after the tank leaves the filling device. A leak detector indicates whether gas is leaking from the tank after being filled.

15 Claims, 6 Drawing Figures

APPARATUS FOR FILLING TANKS WITH LIQUEFIED GAS

BACKGROUND OF THE INVENTION

Tanks filled with liquid carbon dioxide are used for a wide variety of purposes. One of the principal uses of a tank of liquid carbon dioxide is to introduce carbon dioxide into a soft drink to create an effervescent drink. A typical use is in a soda fountain type function or in a vending machine where water, syrup, and carbon dioxide are mixed to produce a soft drink. Inasmuch as tanks of this general type are expensive, it is necessary to refill the tanks with liquid carbon dioxide once the tank is empty. It is particularly desirable to provide an apparatus for receiving empty tanks, filling the tanks with liquid carbon dioxide, and delivering filled tanks.

SUMMARY OF THE INVENTION

The instant apparatus fills tanks with liquid carbon dioxide by first loading empty tanks onto a carrier. Each tank is carried to a filling station where it is filled with liquid carbon dioxide. After each tank is filled, it is moved to another station where it is determined whether the tank is sufficiently filled with liquid carbon dioxide. Each tank is then moved by the carrier to a leak detection station to indicate whether the tank has a leak. Each tank is then discharged from the carrier and the instant apparatus.

DESCRIPTION OF THE PREFERRED EMBODIMENT

Figure 1:
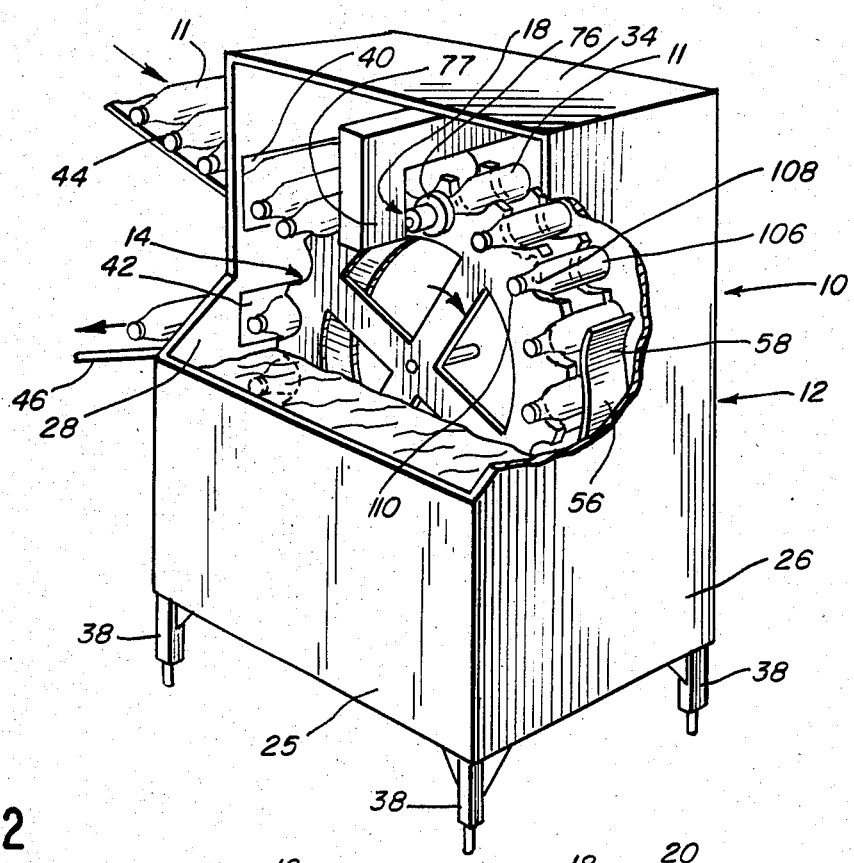
FIG. 1 is a perspective view of an apparatus embodying the herein disclosed invention with portions broken away in order to show better the arrangement of certain parts which are included in the instant apparatus.

Referring now to the drawings, and especially to FIG. 1, a filling apparatus generally indicated by numeral 10 is shown therein which filling apparatus is a specific embodiment of the instant invention. Apparatus 10 is generally designed to fill conventional tank 11 with liquid carbon dioxide. Apparatus 10 includes a cabinet 12 with a carrier 14 rotatably mounted in the cabinet. An incoming weighing station 16, a filling station 18, and an outgoing station 20 are positioned adjacent to the periphery of carrier 14. A leak detector tank 22 is mounted in cabinet 12 and submersibly receives the lower portion of the carrier. Pump assembly 24 is connected to filling station 18 for delivering liquid carbon dioxide under pressure.

Cabinet 12 includes a lower front panel 25 which is connected to a right side panel 26 and a left side panel

28. An upper panel 30 is connected to side panels 26 and 28. A transparent window 32 is positioned between lower front panel 25 and upper front panel 30. A top panel 34 is connected to the side panels and the upper panel. A rear panel 36 is connected to the top panel and the side panels. The cabinet has four legs 38 at four corners for supporting the panels. Panel 28 includes an inlet port 40 and a discharge port 42. A downwardly sloping inlet track or ramp 44 is positioned in inlet port 40. Ramp 44 allows tanks to roll down the ramp into the interior of the cabinet. An off-loading track or discharge ramp 46 is mounted in discharge port 42. Discharge ramp 46 receives filled tanks from the carrier in the cabinet.

Carrier 14 includes an indexing wheel which has an outer annular carrier plate 48 and an inner annular carrier plate 50. The annular carrier plates are connected to each other by a plurality of carrier bars 52. Each of the carrier plates has a scallop opening 54 between each of the carrier bars to form a pocket to receive a tank 11 in each pair of openings. A tank support rail 56 is mounted adjacent to the outer periphery of the wheel. The rail has an ear 58 at one end for receiving tanks and the rail terminates adjacent to the off-loading track 46 so that the rail is adjacent to more than 180° of the outer periphery of the wheel. The wheel rotates on a single axis which is connected to a conventional electric motor 60 through a conventional stopping and indexing control 62. Control 62 rotates the wheel so that each pocket on the wheel stops and is aligned with each station in turn.

Figure 4:
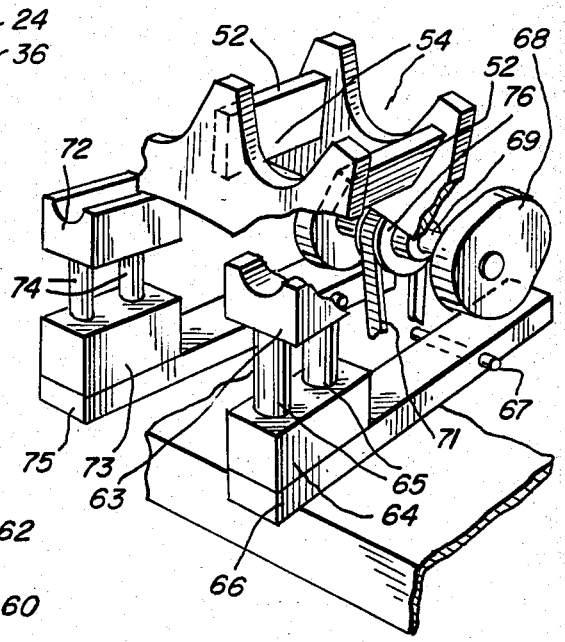
FIG. 4 is an enlarged fragmentary perspective view of a portion of the carrier and a weighing station for weighing tanks.
Figure 5:
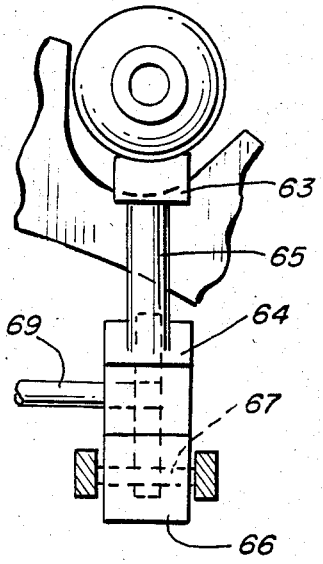
FIG. 5 is an enlarged end elevational view of a tank supported in the weighing station.
Figure 6:
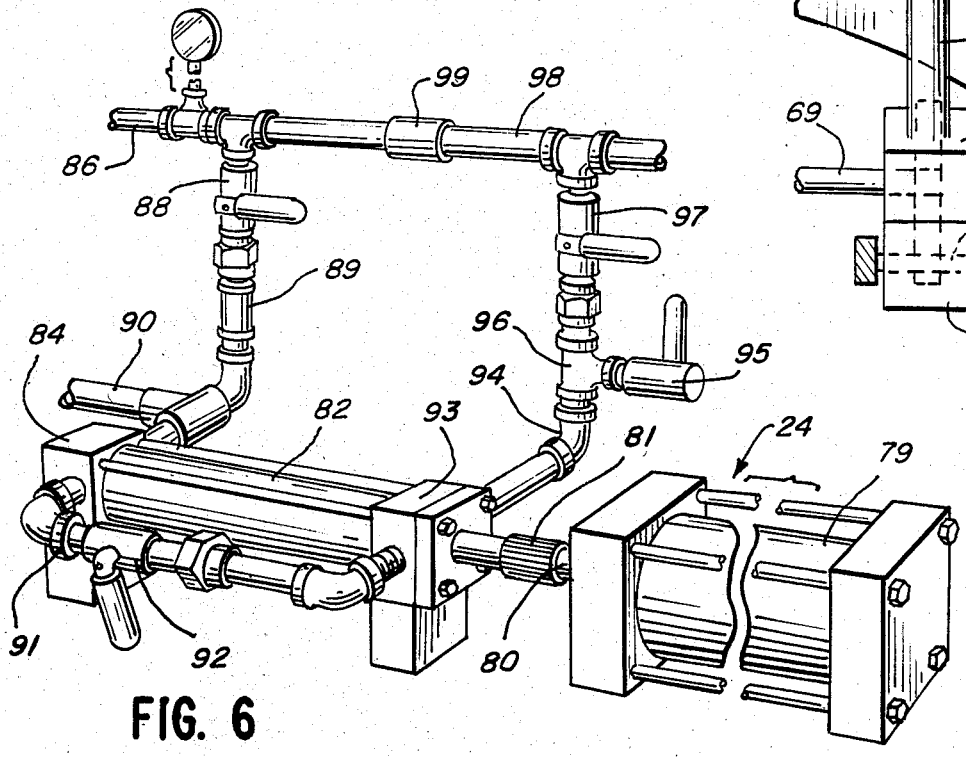
FIG. 6 is an enlarged perspective view of a pump assembly for pumping liquid carbon dioxide into tanks.

Referring now to FIGS. 4 and 5, the construction of outgoing station 20 may be best seen therein. The outgoing station includes a cradle 63 connected to a load cell 64 through a pair of columns 65. Load cell 64 is mounted on a pivot beam 66 which is pivotally mounted on a pivot shaft 67. A cam 68 engages the pivot beam to raise and to lower the cradle. Cam 68 is supported and driven by cam shaft 69. Cam shaft 69 has a pulley 70 drivingly mounted thereon, which pulley is connected to control 62 by a chain belt 71. Cam 68 is rotated when the carrier is stopped. The cam forces one end of beam 66 downward to raise the other end so that cradle 63 engages tank 11 supported in openings 54 of the wheel. The weight of the tank and its contents is determined by load cell 64. Thus, each tank after being filled is weighed to determine the amount of liquid carbon dioxide which was introduced into the tank. Cam 68 is rotated 180° to lower the cradle and thereby reposition the tank in the openings so that the wheel may be rotated again.

Incoming weighing station 16 is constructed in the same manner as outgoing station 20. A cradle 72 is supported on a load cell 73 by a pair of columns 74. The load cell is mounted on a pivot beam 75, which is pivotally supported on a pivot shaft which is not shown. The pivot shaft is identical to pivot shaft 67. A cam, which is not shown but is identical to the construction of cam 68, is supported and driven by cam shaft 69.

At the same time that cam 68 raises cradle 63 to weigh a filled tank, cradle 72 is raised to engage a tank to determine the weight of the tank prior to filling. The weight of the tank indicates whether the tank is completely empty or not. In each instance, the weight of the tank is retained in a conventional microprocessor which is not shown herein. When the tank is again weighed at outgoing station 20 after it has been filled, the weight of the tank and contents is recorded in the microprocessor.

The microprocessor determines the difference in the two weights. The difference represents the weight of liquid carbon dioxide metered to the tank. The weight of the liquid carbon dioxide is displayed by a conventional display device, which is not shown, so that an operator may note the weight of liquid carbon dioxide added to a tank.

The filler or filling station 18 includes a filling head 76 which is adapted for ready connection to a tank. The filling head is connected to a conventional pneumatic cylinder 77 for moving the filler head into and out of engagement with a tank on the wheel positioned at the filling station. The filler head is connected to pump assembly 24 through a conventional hose 78.

Pump assembly 24 includes a conventional pneumatic cylinder 79. Cylinder 79 has an adjustable stroke to control the amount of liquid carbon dioxide which is pumped into a tank at the filling station. Cylinder 79 has a shaft 80 with a threaded sleeve 81 mounted thereon for adjusting the stroke of the cylinder. Shaft 80 is connected to a conventional positive displacement pump 82 for pumping liquid carbon dioxide to the pumping station. Pump 82 has an inlet 84. The inlet of the positive displacement pump is connected to a source of liquid carbon dioxide, which is not shown herein, through pipe 86 with a valve 88 controlling the flow. A check valve 89 is mounted in line with valve 88. The inlet 84 is connected to a pipe 90 which is connected to hose 78 for delivery of liquid carbon dioxide to the filling station. Inlet 84 is connected to a purging circuit wherein a pipe 91 has a valve 92 mounted therein and is connected to head 93 of the positive displacement pump. The purging circuit includes a pipe 94 with a valve 95 connected to a tee 96. A valve 97 controls the outlet to a pipe 98 which is connected to pipe 86 and has a check valve 99 mounted therein. Prior to use of positive displacement pump 88 for filling tanks, the pump and system is purged to eliminte all gaseous carbon dioxide. Once the system is purged, cylinder 79 operates the pump to pump liquid carbon dioxide from the source to the filling station to fill tanks.

Leak detector tank 22 includes a conventional open top container 100 filled with water. A pair of electric heaters 101 is mounted in the container for heating the water. The liquid carbon dioxide is at a temperature of approximately 0° F. so that the water would freeze if the water were not heated by heaters 101. In addition, the maintenance of the water at the surrounding ambient temperature tends to allow the tanks to warm so that there is a greater build up of pressure in the tanks and aids in detecting any leaks in the tanks.

A proximity sensor 102 is positioned above track 46 to detect the presence of a tank on the off-loading track. The proximity sensor is connected to control 62. When a tank is positioned adjacent to the proximity sensor, the control does not allow the wheel to rotate so that no additional tanks are delivered to the off-loading track. This prevents the unwanted delivery of tanks when the off-loading is incapable of keeping up with the delivery of filled tanks.

A plurality of tanks 11 is loaded onto track 44. A gate 103 is positioned in the cabinet to prevent selectively the tanks from entering the wheel. When it is desired to empty the wheel, the gate is operated mechanically to position it to block the track and thereby prevent tanks from entering the wheel.

Each of the tanks 11 is conventional in its construction. Each tank has a body 106 with a neck 108 formed integral therewith. A conventional closure 110 is fitted in the neck. The construction of the tanks is well known in the art.

Figure 2:
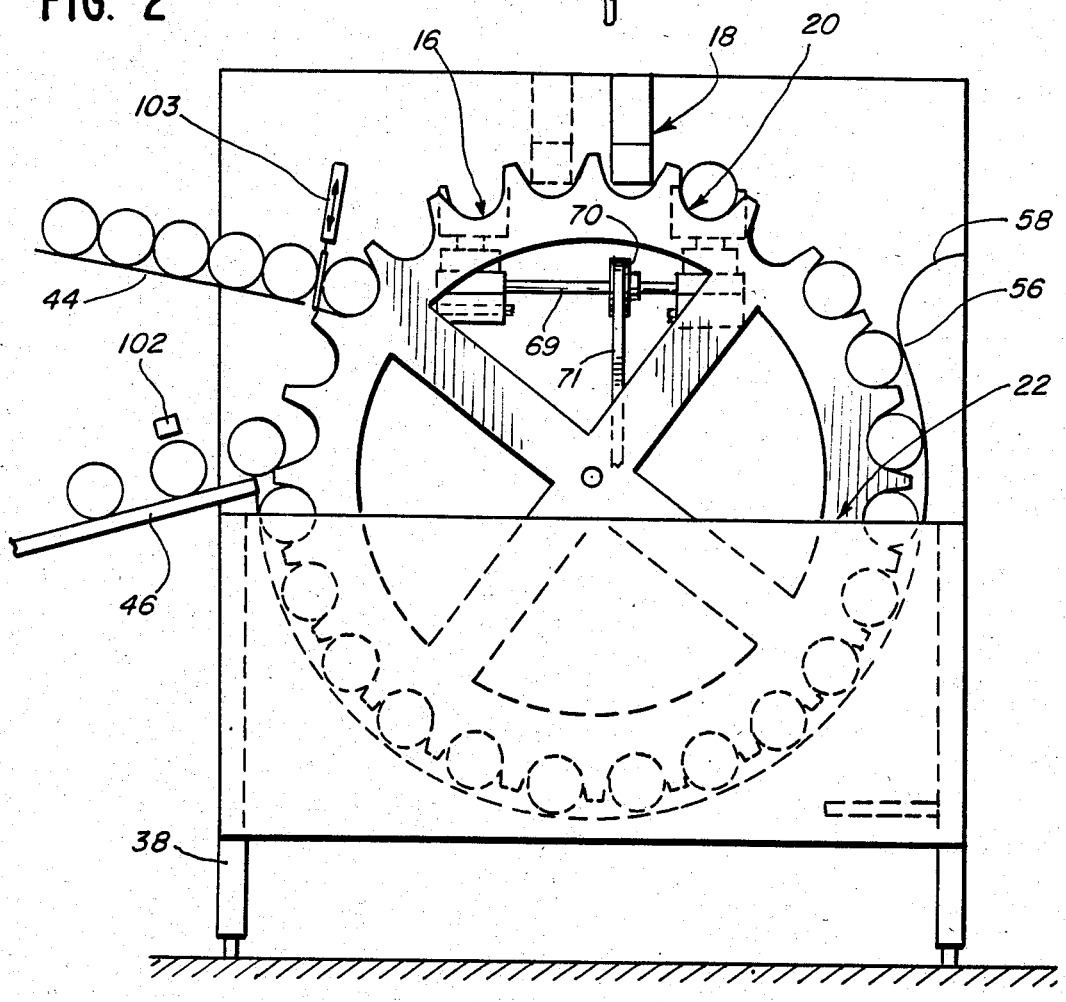
FIG. 2 is an enlarged cross-sectional view showing a carrier of the apparatus of FIG. 1 with tanks contained therein which carrier moves the tanks from one station to another.
Figure 3:
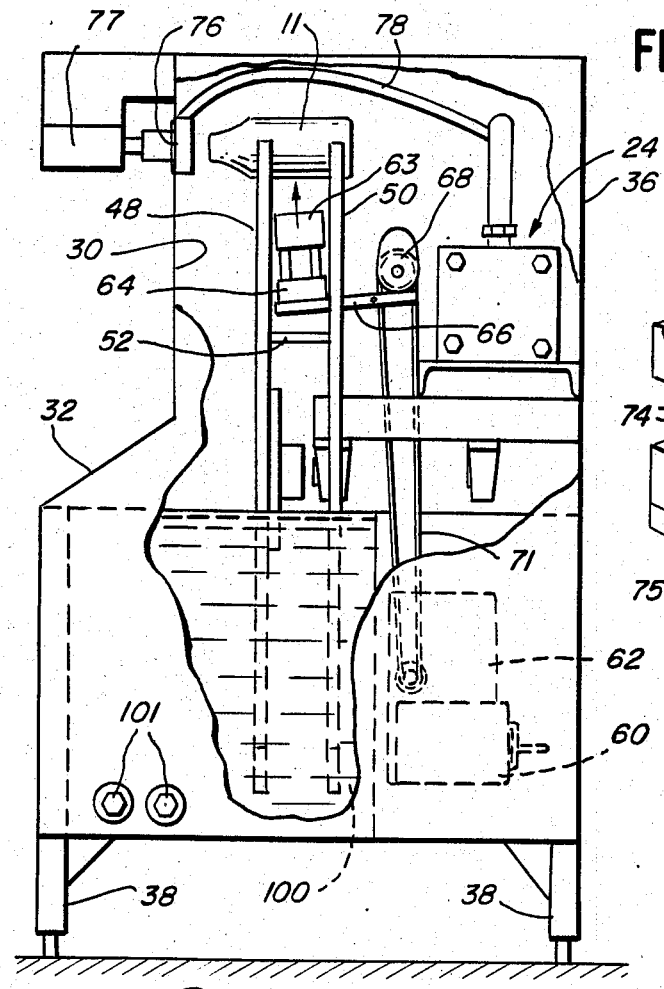
FIG. 3 is an end view of the apparatus of FIG. 1 with portions broken away to show the inner construction of the apparatus.

During ordinary operation when gate 103 is raised, tanks 11 on track 44 roll down the track until a tank drops into an opening or pocket formed by a pair of slots 54 in the indexing wheel. The wheel is rotated about an axle by electric motor 60 through control 62 so that each pair of slots is successively positioned at the various stations. The wheel rotates in a clockwise direction as viewed in FIG. 2. Each tank in a pocket in the wheel first stops at incoming weighing station 16 for a predetermined length of time. When the wheel stops at station 16, the control drives chain belt 71 to raise cradle 72 to engage a tank at the incoming weighing station and record the weight of the tank. The cradle is lowered to replace the tank in the pocket, and the control rotates the indexing wheel a step at a time. The spacing of the stations and the filler is such that when the wheel stops with a pocket at one station, pockets are aligned with the filler and the other station. When the tank is weighed at station 16, the weight of the tank is displayed on a conventional display for an operator, which display is not shown herein. In the event that the weight of the tank is too great, indicating that the tank contains material, the operator removes the tank. If the weight of the tanks falls within a prescribed range, the operator allows the tank to continue on in the carrier. At the same time that the weight of the tank is displayed, the weight is recorded in the microprocessor.

As was mentioned above, the wheel moves step by step. After a tank has been weighed at station 16, the tank is carried to filling station 18. Cylinder 77 moves filling head 76 into engagement with the neck of the tank. Liquid carbon dioxide at a temperature of approximately 0° F. and a pressure of 300 psi is provided at the source of liquid carbon dioxide. Pneumatic cylinder 79 operates pump 82 so that the pump draws the liquid carbon dioxide into the pump through inlet 84. The pneumatic cylinder 79 then moves in the opposite direction to pump the liquid carbon dioxide out of the pump to raise the pressure of the liquid carbon dioxide to between 700 and 800 psi. A prescribed amount of liquid carbon dioxide is forced to flow out of inlet 84 to pipe 90 and is delivered to the tank connected to the filler head. Upon completion of the stroke of the positive displacement pump, which completes delivery of the measured amount of liquid carbon dioxide, cylinder 77 retracks filling head 76. The tank is carried away from the filling station to the next station, which is outgoing station 20. The tank filled with liquid carbon dioxide is weighed. The rotation of cam 68 raises cradle 63 until the tank is supported entirely on the cradle so that the load cell 64 determines the weight of the tank and its contents. The weight of the tank when it is empty and its weight after filling is entered into the microprocessor. The microprocessor indicates the difference in weights, thereby determining the weight of liquid carbon dioxide which was introduced into the tank. The difference is visibly displayed to an operator on a conventional display, which is not shown herein. If there is insufficient liquid carbon dioxide added, the operator removes the tank from the station. The operator also may adjust the stroke of the pneumatic cylinder 79 and thus the positive displacement pump 82 to increase or decrease the quantity of liquid carbon dioxide which is introduced into each of the tanks.

The tanks are carried from station 20 downward with the wheel and engage support rail 56. The support rail keeps the tanks in their respective pockets. The tanks then enter the water in container 100. The operator is able to observe the tanks through window 32. If there is any leakage in any of the tanks, the carbon dioxide bubbles up through the water. The operator then simply notes the tank for removal. The tanks are carried by the wheel out of container 100 until each of the tanks reach the end of support rail 56 and rolls out of the pocket onto off-loading track 46. The tanks are removed from track 46 for transport or storage. A sensor 102 is positioned adjacent to track 46 so that if there are any tanks on track 46 adjacent to the wheel, there is an indication that the tanks are not being removed from the off-loading track. The sensor signals the control to prevent rotation of the wheel so that there is no needless buildup of tanks.

Since the temperature of the liquid carbon dioxide is approximately 0° F., it may be appreciated that when the apparatus is being started, it is necessary to purge the pump assembly and pipe of gaseous carbon dioxide and air. The purging circuit allows gaseous carbon dioxide and air to be removed from the system. Once the gaseous carbon dioxide is expelled, valve 92 is closed to allow the system to fill tanks as described above.

Although a specific embodiment of the herein disclosed invention has been shown and described in detail above, it is readily apparent that those skilled in the art may make various modifications and changes without departing from the spirit and scope of the present invention. It is to be expressly understood that this invention is limited only by the appended claims.

I claim:

1. An apparatus for filling tanks with a liquid gas comprising, in combination, a carrier for receiving tanks for holding a liquid gas, a drive connected to the carrier for moving the carrier to transfer the tanks from one station to another in the apparatus, a filling station filler at the filling station for delivering liquid gas under pressure to a tank at the filling station, a device at another station to determine whether a given tank is filled with liquid gas after being filled by the filler, and a leak detector at a third station to determine whether gas is leaking from the tank after being filled, the carrier includes an indexing wheel having a plurality of pockets, each of said pockets being adapted to receive a tank adapted for storing liquid gas, and said drive is adapted to rotate the wheel intermittently to move the pockets of the wheel from station to station and to hold the pockets at each of the stations.

2. An apparatus for filling tanks with a liquid gas comprising, in combination a carrier for receiving tanks for holding liquid gas, a drive connected to the carrier for moving the carrier to transfer the tanks from one station to another in the apparatus, a filling station filler at the filling station for delivering liquid gas under pressure to a tank at the filling station, a device at another station to determine whether a given tank is filled with liquid gas after being filled by the filler, a leak detector at a third station to determine whether gas is leaking from the tank after being filled, the carrier includes an indexing wheel having a plurality of pockets, said wheel being rotatable on an axis which is substantially parallel with the horizontal, each of said pockets being adapted to receive a tank for storing liquid gas therein, said drive is adapted to rotate the wheel intermittently to move the pockets from one station to another, and a tank support rail positioned adjacent to the lower portion of the outer periphery of the wheel for retaining tanks in the pockets of the wheel.

3. An apparatus for filling tanks with a liquid gas comprising, in combination, a carrier for receiving tanks for holding a liquid gas, a drive connected to the carrier for moving the carrier to transfer the tanks from one station to another in the apparatus, a filling station filler at the filling station for delivering liquid gas under pressure to a tank at the filling station, a device at another station to determine whether a given tank is filled with liquid gas after being filled by the filler, a leak detector at a third station to determine whether gas is leaking from the tank after being filled, a discharge ramp for receiving tanks filled with liquid gas from the carrier, and a tank detector mounted in cooperation with the ramp, whereby a filled tank being positioned on the ramp adjacent to the tank detector prevents movement of the carrier to prevent discharge of additional filled tanks.

4. An apparatus for filling tanks with a liquid gas comprising, in combination, a carrier for receiving tanks for holding a liquid gas, a drive connected to the carrier for moving the carrier to transfer the tanks from one station to another in the apparatus, a filling station filler at the filling station for delivering liquid gas under pressure to a tank at the filling station, a device at another station to determine whether a given tank is filled with liquid gas after being filled by the filler, and a leak detector at a third station to determine whether gas is leaking from the tank after being filled, the carrier includes an indexing wheel having a plurality of pockets, each of said pockets being adapted to receive a tank for storing liquid carbon dioxide, and said drive rotates the wheel intermittently to move the pockets with the tanks contained therein, and including an instrument at a station prior to the filling station to indicate the capacity of a tank to receive liquid gas prior to being transferred to the filler by the wheel.

5. An apparatus for filling tanks with a liquid gas comprising, in combination, a carrier for receiving tanks for holding a liquid gas, a drive connected to the carrier for moving the carrier to transfer the tanks from one station to another in the apparatus, a filling station filler at the filling station for delivering liquid gas under pressure to a tank at the filling station, a device at another station to determine whether a given tank is filled with liquid gas after being filled by the filler, and a leak detector at a third station to determine whether gas is leaking from the tank after being filled, an instrument at a station prior to the filling station to indicate the capacity of a tank to receive liquid gas prior to being transferred to the filler by the carrier, an off-loading track for receiving tanks filled with liquid gas from the carrier, and a tank detector mounted in coooperation with the track, whereby a filled tank positioned on the track adjacent to the tank detector prevents movement of the carrier to prevent discharge of additional filled tanks onto the track.

6. An apparatus for filling tanks with a liquid gas comprising, in combination, a carrier for receiving tanks for holding a liquid gas, a drive connected to the carrier for moving the carrier to transfer the tanks from one station to another in the apparatus, a filling station filler at the filling station for delivering liquid gas under pressure to a tank at the filling station, a device at another station to determine whether a given tank is filled with liquid gas after being filled by the filler, a leak detector at a third station to determine whether gas is leaking from the tank after being filled, the carrier includes an indexing wheel having a circular outer periphery and a plurality of pockets formed in its outer periphery, said wheel being rotatable on a substantially horizontal axis, each of said pockets being adapted to receive a tank, said drive is adapted to rotate the wheel intermittently to move the pockets, each of said pockets being moved from one station to the next station consecutively, and a tank support rail positioned adjacent to the outer periphery of the wheel for retaining tanks in the pockets, said support rail extending in excess of 180° of the arch of the circle of the wheel.

7. An apparatus for filling tanks with a liquid gas comprising, in combination, a carrier for receiving tanks for holding a liquid gas, a drive connected to the carrier for moving the carrier to transfer the tanks from one station to another in the apparatus, a filling station filler at the filling station for delivering liquid gas under pressure to a tank at the filling station, a device at another station to determine whether a given tank is filled with liquid gas after being filled by the filler, and a leak detector at a third station to determine whether gas is leaking from the tank after being filled, the carrier includes an indexing wheel having a plurality of pockets in its outer periphery, each of said pockets being adapted to receive a tank adapted for storing liquid gas, said drive rotating the wheel intermittently to index each of the pockets from one station to another, said filler including a positive displacement pump for metering a given volume of liquid gas into a tank held in each of the pockets of the carrier.

8. An apparatus for filling tanks with a liquid gas comprising, in combination, a carrier for receiving tanks for holding a liquid gas, a drive connected to the carrier for moving the carrier to transfer the tanks from one station to another in the apparatus, a filling station filler at the filling station for delivering liquid gas under pressure to a tank at the filling station, a device at another station to determine whether a given tank is filled with liquid gas after being filled by the filler, a leak detector at a third station to determine whether gas is leaking from the tank after being filled, the carrier includes an indexing wheel having a plurality of pockets, each of said pockets being adapted to receive a tank adapted for storing liquid gas, said drive is adapted to rotate the wheel intermittently to move the tanks from one station to another, including a discharge ramp for receiving tanks filled with liquid gas from the carrier, a tank detector cooperating with the ramp, whereby a filled tank positioned on the ramp in a given position adjacent to the tank detector prevents the drive from operating to move the carrier and thereby discharge additional filled tanks from the carrier.

9. An apparatus for filling tanks with a liquid gas comprising, in combination, a carrier for receiving tanks for holding a liquid gas, a drive connected to the carrier for moving the carrier to transfer the tanks from one station to another in the apparatus, a filling station filler at the filling station for delivering liquid gas under pressure to a tank at the filling station, a device at another station to determine whether a given tank is filled with liquid gas after being filled by the filler, a leak detector at a third station to determine whether gas is leaking from the tank after being filled, the leak detector includes a container of water for submersibly receiving tanks filled with liquid gas carried by the carrier, and a heater in the water for heating the water to keep the water at a temperature above the freezing point of water, the carrier includes an indexing wheel having a plurality of tank receiving pockets in its outer periphery, said wheel having a portion in the water of the container, and said drive is adapted to rotate the wheel intermittently to move the pockets from one station to another.

10. An apparatus for filling tanks with a liquid gas comprising, in combination, a carrier for receiving tanks for holding a liquid gas, a drive connected to the carrier for moving the carrier to transfer the tanks from one station to another in the apparatus, a filling station filler at the filling station for delivering liquid gas under pressure to a tank at the filling station, a device at another station to determine whether a given tank is filled with liquid gas after being filled by the filler, a leak detector at a third station to determine whether gas is leaking from the tank after being filled, the filler for delivering liquid gas under pressure to a tank includes a positive displacement pump for delivering a given volume of liquid gas to the tank, said carrier including an indexing wheel having a plurality of pockets formed in its outer periphery, said wheel being rotatable on a substantially horizontal axis, each of said pockets being adapted to receive a tank for storing liquid gas, said drive is adapted to rotate the wheel intermittently to move the pockets from one station to another, and a tank support rail positioned adjacent to the outer periphery of a portion of the wheel for retaining tanks in the pockets of the wheel.

11. An apparatus for filling tanks with a liquid gas comprising, in combination, a carrier for receiving tanks for holding a liquid gas, a drive connected to the carrier for moving the carrier to transfer the tanks from one station to another in the apparatus, a filling station filler at the filling station for delivering liquid gas under pressure to a tank at the filling station, a device at another station to determine whether a given tank is filled with liquid gas after being filled by the filler, a leak detector at a third station to determine whether gas is leaking from the tank after being filled, the carrier includes an indexing wheel having a plurality of pockets formed in its outer periphery, said wheel being rotatable on a substantially horiztonal axis, each of said pockets being adapted to receive a tank for storing a liquid gas therein, said drive is adapted to intermittently rotate the wheel to move the tanks in the pockets from one station to another, a tank support rail positioned adjacent to the outer periphery of the wheel for retaining tanks in the pockets of the wheel when those pockets are in the lower half of the wheel, a discharge ramp positioned adjacent to the wheel for receiving tanks filled with liquid gas from the pockets of the wheel, and a tank detector cooperative with the ramp, whereby a filled tank positioned on a selected portion of the ramp activates the tank detector to prevent movement of the wheel and thereby prevent discharge of additional filled tanks from the wheel onto the ramp.

12. An apparatus for filling tanks with a liquid gas comprising, in combination, a carrier for receiving tanks for holding a liquid gas, a drive connected to the carrier for moving the carrier to transfer the tanks from one station to another in the apparatus, a filling station filler at the filling station for delivering liquid gas under pressure to a tank at the filling station, a device at another station to determine whether a given tank is filled with liquid gas after being filled by the filler, a leak detector at a third station to determine whether gas is leaking from the tank after being filled, the carrier includes an indexing wheel having a plurality of pockets formed in its outer periphery for receiving tanks for storing a liquid gas therein, said wheel being rotatable on a substantially horizontal axis, said drive intermittently rotating the wheel to move tanks positioned in the pockets from one station to another, a tank support rail positioned adjacent to the outer periphery of the wheel in the lower portion for retaining tanks in the pockets, said leak detector including a container of water having the wheel partially submerged therein for submersibly receiving tanks filled with liquid gas carried in the pockets of the wheel, and a heater in the water for heating the water to keep the water at a temperature above the freezing point of water, whereby any tank leaking gas being submerged in the water sends bubbles of gas through the water to provide visible evidence that the tank is leaking.

13. An apparatus for filling tanks with a liquid gas comprising, in combination, a carrier for receiving tanks for holding a liquid gas, a drive connected to the carrier for moving the carrier to transfer the tanks from one station to another in the apparatus, a filling station filler at the filling station for delivering liquid gas under pressure to a tank at the filling station, a device at another station to determine whether a given tank is filled with liquid gas after being filled by the filler, a leak detector at a third station to determine whether gas is leaking from the tank after being filled, the filler for delivering liquid gas under pressure includes a positive displacement pump adapted for metering a selected volume of liquid gas into a tank, and including a discharge ramp for receiving tanks filled with liquid gas from the carrier, and a tank detector cooperating with the ramp, whereby a tank positioned on a selected portion of the ramp activates the tank detector to prevent movement of the carrier and thereby prevent discharge of additional tanks from the carrier to the discharge ramp.

14. An apparatus for filling tanks with a liquid gas comprising, in combination, a carrier for receiving tanks for holding a liquid gas, a drive connected to the carrier for moving the carrier to transfer the tanks from one station to another in the apparatus, a filling station filler at the filling station for delivering liquid gas under pressure to a tank at the filling station, a device at another station to determine whether a given tank is filled with liquid gas after being filled by the filler, a leak detector at a third station to determine whether gas is leaking from the tank after being filled, the carrier includes an indexing wheel having a plurality of pockets formed in its outer periphery, each of said pockets being adapted to receive a tank adapted for storing liquid gas therein, said drive is adapted to intermittently rotate the wheel to index the pockets of the wheel from one station to another to have operations performed on tanks in the pockets or in conjunction with the tanks at each of the stations, an instrument to indicate the capacity of a tank to receive liquid gas prior to being transferred to the filler by the wheel, a discharge ramp positioned adjacent to the outer periphery of the wheel for receiving tanks filled with liquid gas from the wheel, a tank detector adjacent to the ramp to be activated by a tank on the ramp to prevent discharge of additional tanks from the wheel while the tank on the ramp activates the detector, a tank support rail positioned adjacent to the outer periphery of the wheel and at the lower portion of the wheel for retaining tanks in the pockets of the wheel, said filler for delivering liquid gas under pressure including a positive displacement pump for metering liquid gas into each of the tanks, means for adjusting the stroke of the pump to adjust the amount of liquid gas delivered by the pump, said leak detector including a container of water submersibly receiving a portion of the wheel for submersibly receiving tanks filled with liquid gas carried in the pockets of the wheel, and a heater in the water for heating the water to keep the water at a temperature above the freezing point of water.

15. An apparatus for filling tanks with liquid carbon dioxide comprising, in combination, a cabinet, a carrier rotatably mounted in said cabinet, said carrier being rotatable about a substantially horizontal axis, said carrier including an indexing wheel having a plurality of pockets formed in its outer periphery, each of said pockets being adapted to receive one of the tanks adapted for storing liquid carbon dioxide, a drive connected to the carrier for rotating the carrier intermittently, a sloping track for delivering empty tanks to the interior of the cabinet and positioning an empty tank in each pocket of the indexing wheel, a loading gate cooperative with the sloping track to control selectively the positioning of empty tanks to the indexing wheel, an incoming weighing station positioned adjacent to the indexing wheel for weighing each empty tank to indicate the capacity of each tank to receive liquid carbon dioxide, a filling station adjacent to the indexing wheel for receiving tanks from the incoming weighing station, said filling station having a filling head engageable with a tank to deliver liquid carbon dioxide into the tank, a metering pump connected to the filling head for delivering a given volume of liquid carbon dioxide into a tank connected to the filling head, a fluid operated cylinder connected to the metering pump for operating the metering pump, an adjustment connector connected to the fluid cylinder to regulate the stroke of the metering pump and thereby regulate the volume of liquid carbon dioxide delivered to the filling head, a tank support rail positioned adjacent to the outer periphery of the wheel and at the lower portion of the wheel for retaining tanks in the pockets of the wheel, an outgoing station positioned adjacent to the wheel for receiving tanks from the filling station to indicate the amount of liquid carbon dioxide contained in the tank, a water container receiving a lower portion of the indexing wheel and being filled with water to detect leakage of carbon dioxide from each tank as it passes through the water container, a heater in the water container for heating the water to keep the water at a temperature above the freezing point of water, an off-loading track for receiving tanks leaving the water container, and a tank detector connected to the off-loading track to interrupt the rotation of the carrier to prevent tanks from being delivered to the off-loading track when the off-loading track has more tanks thereon than a given quantity.

* * * * *